US007080416B1

(12) United States Patent
Portnell

(10) Patent No.: US 7,080,416 B1
(45) Date of Patent: Jul. 25, 2006

(54) BATH CADDY

(76) Inventor: Kara Portnell, 87 Delmont Dr., Atlanta, GA (US) 30305

( * ) Notice: Subject to any disclaimer, the term of this patent is extended or adjusted under 35 U.S.C. 154(b) by 0 days.

(21) Appl. No.: 11/260,549

(22) Filed: Oct. 28, 2005

(51) Int. Cl.
*A47K 3/00* (2006.01)

(52) U.S. Cl. ..... 4/559; 211/119.011; D6/525

(58) Field of Classification Search ..... 4/546, 4/548, 559, 605, 630, 661; 211/119.011, 211/85.25, 41.4; D6/525
See application file for complete search history.

(56) References Cited

U.S. PATENT DOCUMENTS 604,803 A * 5/1898 Strauss ..... 211/119.011
2,183,441 A * 12/1939 Bentz ..... 4/574.1
2,659,491 A * 11/1953 Williams ..... 4/559
6,115,857 A * 9/2000 Bidegain ..... 4/574.1

* cited by examiner

*Primary Examiner*—Tuan Nguyen

(57) ABSTRACT

Bath Caddy with a multi-sectioned, multi leveled tray portion made of rigid material such as injection molded acrylic plastic, the tray sections including a left and right narrow and deep portion and a central wide and shallow portion, the central tray section including a pair of horizontally disposed shaft retaining enclosures, the shaft retainers each capable of slidably holding a first leg of an L shaped rigid tub grasping rod, the second leg of the tub grasping rod sheathed in a flexible plastic tube, and the shaft retaining enclosures each including a threaded aperture allowing a thumb screw to be threaded into the wall of the shaft retaining enclosure and impinge upon the first leg of the tub grasping rod to allow the user to adjust the distance between the second leg of the L shaped rod and the wall of a bathtub.

7 Claims, 5 Drawing Sheets

BATH CADDY

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of portable article holding devices and more specifically to a bath caddy.

Bathtubs are commonly used for bathing purposes around the world. Traditionally, a bathtub includes side walls and a base which together retain water for bathing. During the process of bathing, many people prefer to have a variety of supplies at their disposal. Current method of storing bath related supplies include setting items on the top lip of the bathtub side wall, or setting items in a holder or caddy that can attached to a wall or hang from the shower spigot.

One such caddy was invented by David Bellamy and issued U.S. Pat. No. 5,823,366 in October 1998.

The Bellamy design includes a tray that sits on top of the tub wall and a magazine rack that descends downward along the outside of the tub wall. However, there are deficiencies in the Bellamy design as well as other caddies that have been invented in past years. For example, the Bellamy design does not allow the user to compactly store the caddy because of its L shaped construction. Additionally, the design does not take into account the variety of sizes and shapes of items that might be stored in the caddy, such as tall thin items which need to be stored in an upright position. Furthermore, the screw type adjustment means of the tub gripping arms is time consuming and difficult to align. Additionally, the tray in the Bellamy design is not firmly held in place, but merely sitting on top of the wire frame attachment structure, which could accidentally be knocked off. Finally, because the tray portion is located on top of the tub wall, there is danger of knocking items over and out of the tray when entering or exiting the bathtub.

BRIEF SUMMARY OF THE INVENTION

The primary object of the invention is to provide a bath caddy that easily attaches to the side wall of a bathtub regardless of the wall's thickness.

Another object of the invention is to provide a bath caddy that includes a plurality of levels and partitions to accommodate a wide variety of bath related items.

Another object of the invention is to provide a bath caddy that can be positioned inside the tub wall or outside the tub wall.

A further object of the invention is to provide a bath caddy whose attachment arms are removable and replaceable for compact storage and shipping.

Yet another object of the invention is to provide a bath caddy that is easy and economical to manufacture.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed Bath Caddy comprising: a multi-sectioned, multi leveled tray portion made of rigid material such as injection molded acrylic plastic, said tray sections including a left and right narrow and deep portion and a central wide and shallow portion, said central tray section including a pair of horizontally disposed shaft retaining enclosures, said shaft retainers each capable of slidably holding a first leg of an L shaped rigid tub grasping rod, the second leg of said tub grasping rod sheathed in a flexible plastic tube, and said shaft retaining enclosures each including a threaded aperture allowing a thumb screw to be threaded into the wall of said shaft retaining enclosure and impinge upon said first leg of said tub grasping rod to allow the user to adjust the distance between said second leg of said L shaped rod and the wall of a bathtub.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
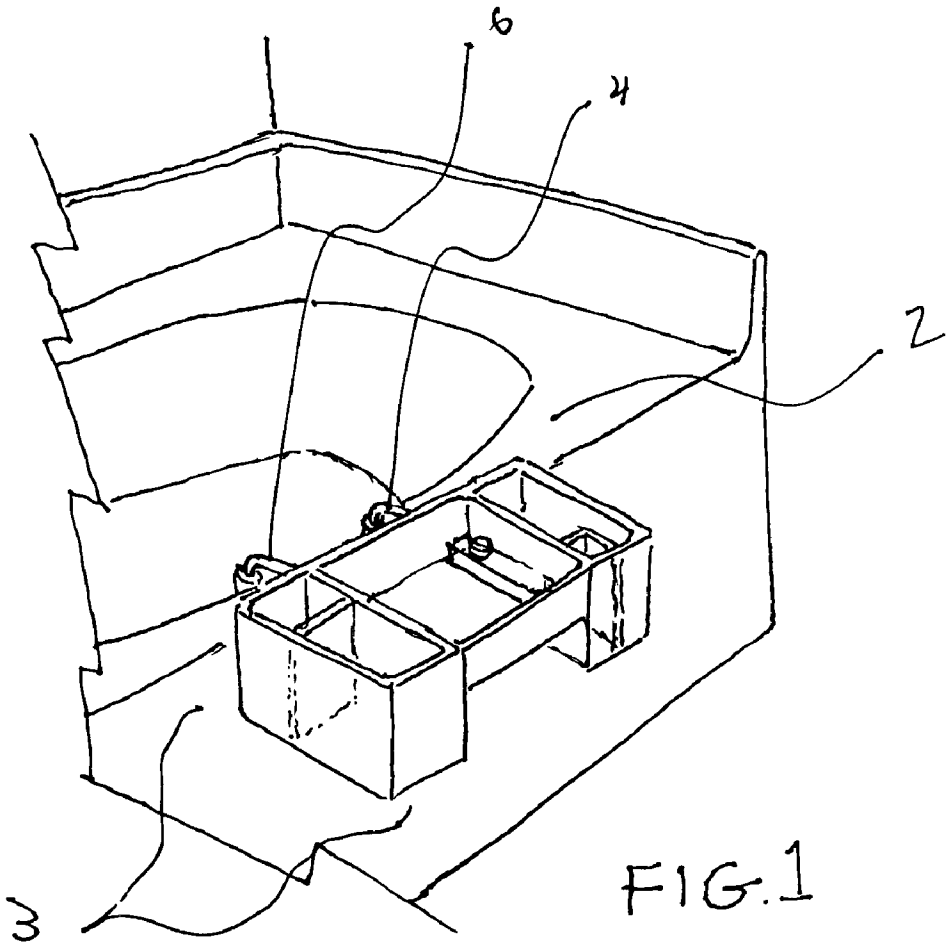
FIG. 1 is a perspective view of the invention.
Figure 2:
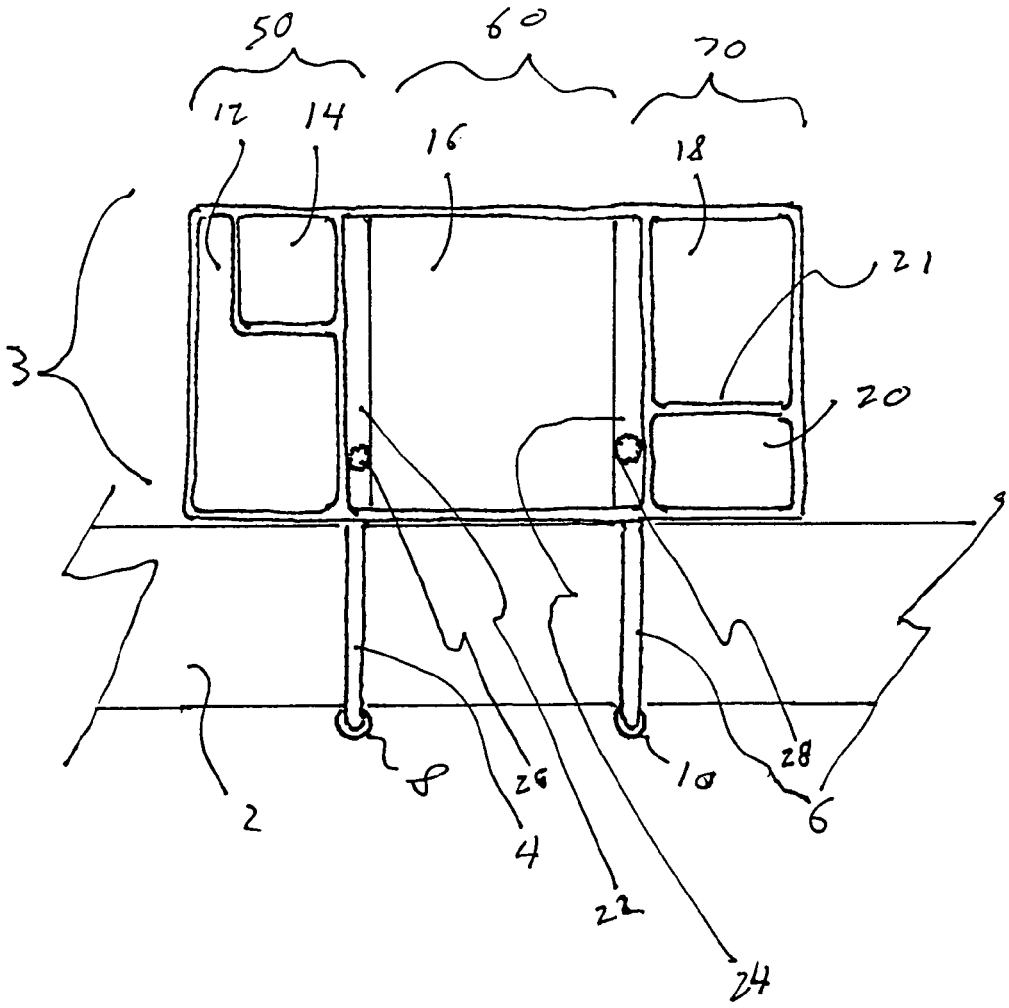
FIG. 2 is a top plan view of the invention.
Figure 3:
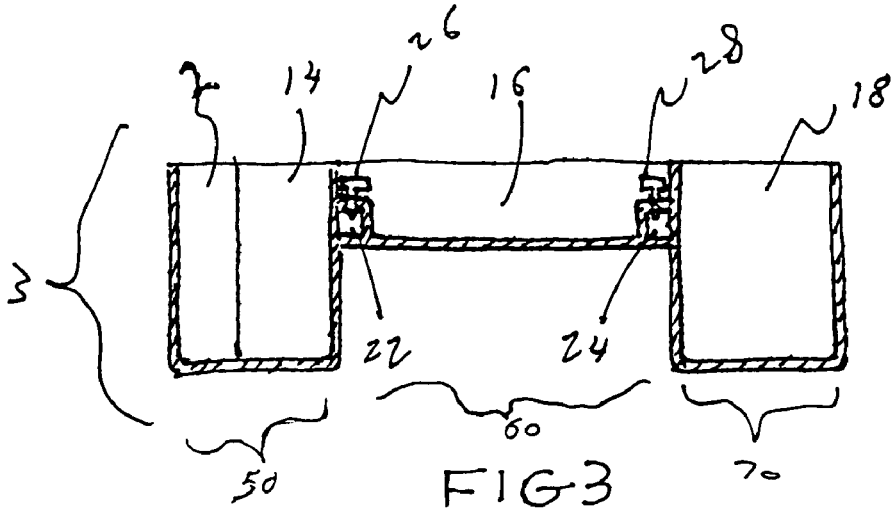
FIG. 3 is a front section view of the invention.
Figure 4:
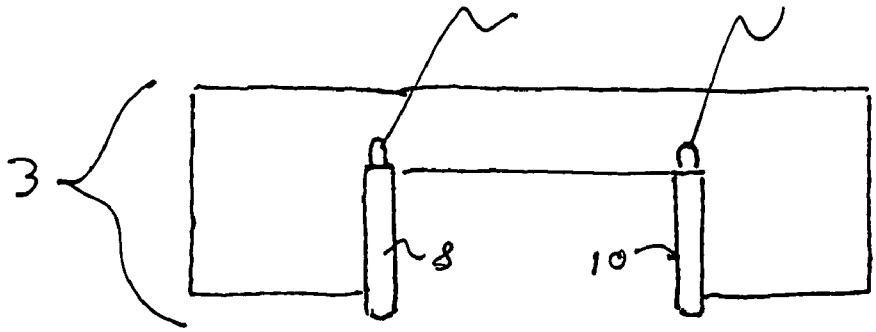
FIG. 4 is a front view of the invention.
Figure 5:
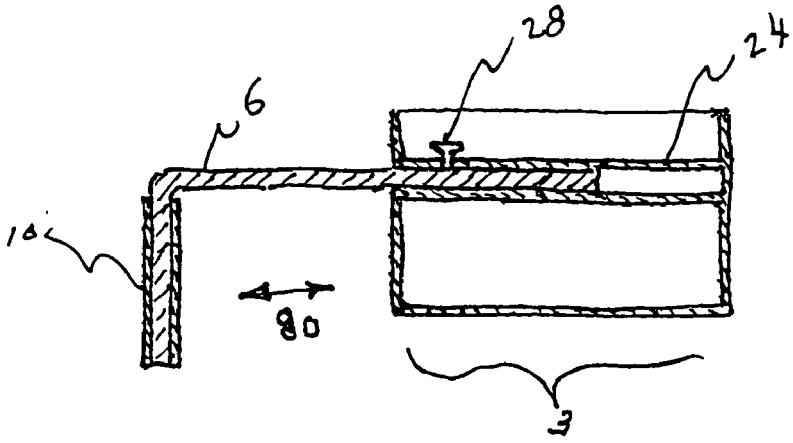
FIG. 5 is side section view of the invention.
Figure 6:
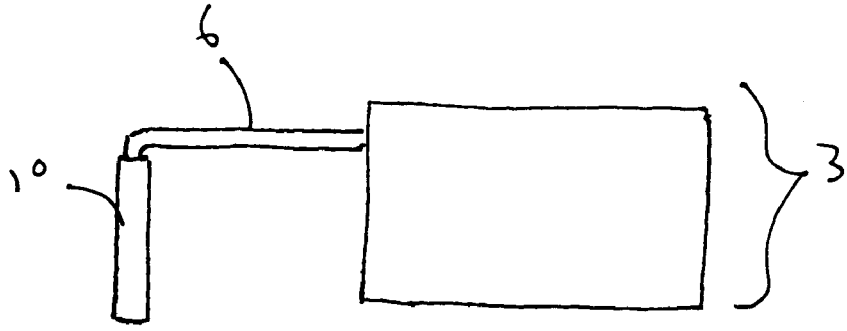
FIG. 6 is a side view of the invention.
Figure 7:
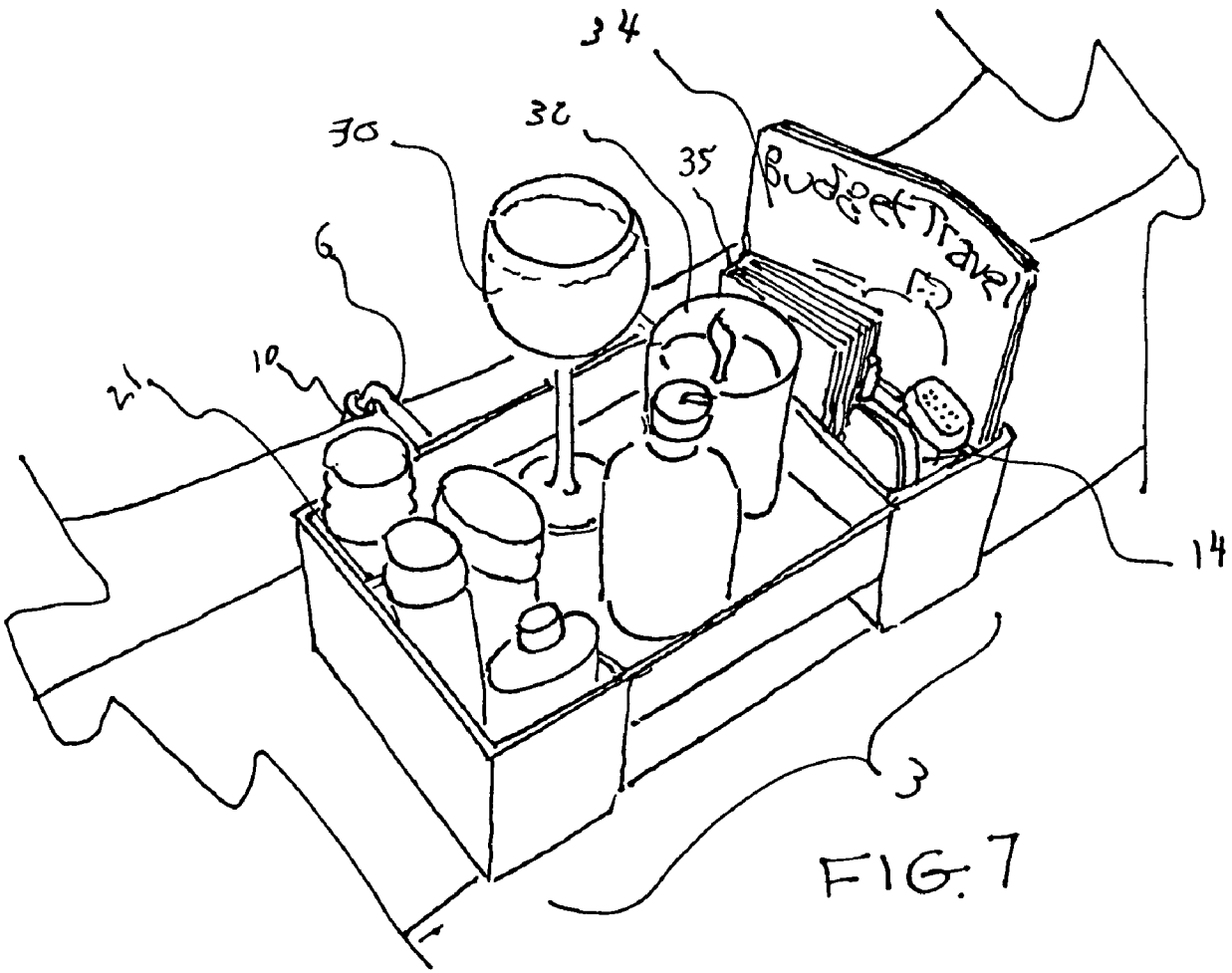
FIG. 7 is a perspective view of the invention in use.

Referring now to FIG. 1 we see a perspective view of the invention being removably attached to the side wall of a bathtub 2. The invention is comprised of a tray portion 3 and L shaped arms 4, 6. The tray portion 3 can be positioned outside the tub as shown or lifted and rotated one hundred and eighty degrees so that is can be stored inside the tub when not in use for bath purposes. The version of the tray 3 shown in FIG. 1 is constructed of transparent acrylic so that the user can easily see the contents of the tray. FIG. 2 shows a top plan view of the invention showing the tray portion 3 attached by L shaped retaining arms 4, 6 to bathtub side wall 2. The L shaped arms are made of aluminum rod or other stiff material. One leg of each of the L shaped arms 4, 6 slides into leg enclosures 22, 24 and are held in place by thumb screws 26, 28. Left Tray portion 50 includes section 12 which is ideally shaped for holding magazines and books and section 14 which is ideal for holding tall thin items thereby preventing them from falling over. Central portion 60 includes flat portion 16 which is wide and shallow and is ideal for holding items such as candles, drinking vessels and other low profile items such as paper and pens and snacks. Also shown in section 16 are leg enclosures 22, 24. Right portion 70 includes sections 18 and 20 that are separated by wall 21. Section 20 is ideal for holding a cell phone or remote phone. Section 21 is ideally suited to retain standard bath items such as shampoo, conditioner, shaving cream, bath oils and soaps. FIG. 3 shows a front section view of the invention. The depth of portions 50 and 70 are deep enough to hold tall bath related items and the depth of central portion 60 is ideal for low profile items as described above. Leg enclosures 22, 24 include threaded apertures that retain thumb screws 26, 28 which can be tightened onto leg portions 4, 6 thereby holding tray portion 3 snuggly against the side wall of a bathtub. FIG. 4 is a front view of the invention. FIG. 5 is a side section view of the invention. This view clearly shows how L shaped leg 6 can slide into leg retaining enclosure 24 and can be adjusted in or out as shown by arrow indicator 80. Leg 6 is covered with flexible plastic tubing 10 that is preferably made of polyurethane because of its soft yet high sticktion qualities. FIG. 6 is a side view of the invention. FIG. 7 is a perspective view of the invention showing the tray 3 loaded with items used during bath time such as magazine 34, book 35, drinking vessel 30 candle 32 and bath powder 14. For storage purposes, L shaped legs may be easily removed and the entire tray 3 may be compactly stored in a cabinet, closet or other storage space.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A bath caddy comprising:

a multi-sectioned, multi leveled tray portion made of rigid material such as injection molded acrylic plastic;

said tray sections including a left and right narrow and deep portion and a central wide and shallow portion;

said central tray section including a pair of horizontally disposed shaft retaining enclosures;

said shaft retainers each capable of slidably holding a first leg of an L-shaped rigid tub grasping rod;

a second leg of said tub grasping rod sheathed in a flexible plastic tube; and said shaft retaining enclosures each including a threaded aperture allowing a thumb screw to be threaded into the wall of said shaft retaining enclosure and impinge upon said first leg of said tub grasping rod to allow the user to adjust the distance between said second leg of said L-shaped rod and the wall of a bathtub.

2. The bath caddy as claimed in claim 1 wherein said multi-sectioned tray can be placed on the inside wall of said bathtub or on the outside wall of said bathtub.

3. The bath caddy as claimed in claim 1 wherein said flexible plastic tube is made of anti-slip material such as polyurethane.

4. The bath caddy as claimed in claim 1 wherein said L-shaped rods are easily removable and replaceable for compact storage and shipping.

5. The bath caddy as claimed in claim 1 wherein said left side tray includes a section wide enough to retain a standard magazine.

6. The bath caddy as claimed in claim 1 wherein said central portion of said tray is shallow enough to hold a beverage in a standard drinking vessel and have a significant portion of said vessel able to exceed the top edge of said tray so that a user can easily grasp said drinking vessel during bathing.

7. The bath caddy as claimed in claim 1 further wherein said left and right tray sections include additional partitions that allow thin, tall items to be retained in the standing position without danger of falling over.

* * * * *